United States Patent [19]

Hightower

[11] 4,081,980

[45] Apr. 4, 1978

[54] ELECTRIC SECURITY LOCK

[76] Inventor: Tafari Hightower, 765 Rand Ave., Oakland, Calif. 94610

[21] Appl. No.: 652,103

[22] Filed: Jan. 26, 1976

[51] Int. Cl.[2] ..... E05B 65/10

[52] U.S. Cl. ..... 70/92; 70/129; 292/21; 292/92; 292/140

[58] Field of Search ..... 70/92, 129; 292/21, 292/92, 137, 138, 140; 200/61.67, 61.64; 116/9; 292/DIG. 65

[56] References Cited

U.S. PATENT DOCUMENTS

| | | | |
|---|---|---|---|
| 213,064 | 3/1879 | Pond | 200/61.67 |
| 986,816 | 3/1911 | Girrens | 292/21 |
| 1,068,738 | 7/1913 | Clark et al. | 116/9 |
| 1,093,809 | 4/1914 | Voight | 200/61.67 |
| 2,818,475 | 12/1957 | Harry | 200/61.67 X |
| 2,958,215 | 11/1960 | Heyman | 70/92 |
| 3,097,007 | 7/1963 | Eichacker et al. | 292/92 |
| 3,271,982 | 9/1966 | Welch | 292/92 X |
| 3,432,631 | 3/1969 | Deutscher et al. | 70/92 X |
| 3,435,643 | 4/1969 | Pollak et al. | 70/92 |
| 3,477,260 | 11/1969 | Balducci et al. | 70/92 |

FOREIGN PATENT DOCUMENTS

| | | | |
|---|---|---|---|
| 440,516 | 1/1936 | United Kingdom | 70/129 |

*Primary Examiner*—Roy D. Frazier

*Assistant Examiner*—Rodney H. Bonck

[57] ABSTRACT

The present invention is an electric security lock which not only provides an alarm signal to an alarm device, but which also has a push bar emergency release. The electric security lock includes a dead bolt, a frame adapted to slideably receive the dead bolt, a cover plate coupled to the frame for holding the dead bolt in place, a pair of cams coupled to the dead bolt and adapted to move the dead bolt in a lateral direction, a locking cylinder coupled to each of the cams, and an electric activating apparatus coupled to the dead bolt. The electric activating apparatus includes a circular latch member pivotally mounted and spring coupled to the dead bolt, a metal bar with a first end and a second end having a square hole disposed midway between the first and second holes, the first end of the metal bar is adapted to be coupled and uncoupled mechanically to the circular latch member, and a micro electronic switch mechanically coupled to the square hole of the bar and electrically coupled to an alarm device. The electric security lock also includes an emergency release mechanism which activates the circular latch member and which has a device for retracting the dead bolt from its projected position and a device for deactivating the electric activating apparatus when an appropriate key is used, mechanically coupled to the retracting device.

4 Claims, 15 Drawing Figures

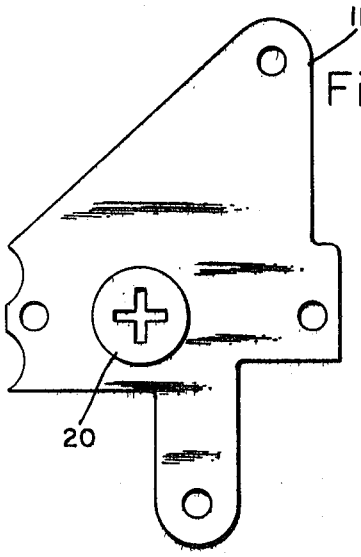
Fig. 13.
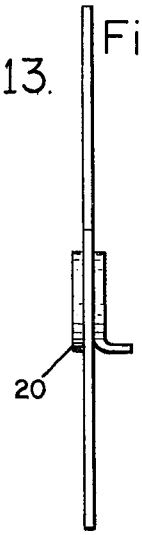
Fig. 12.
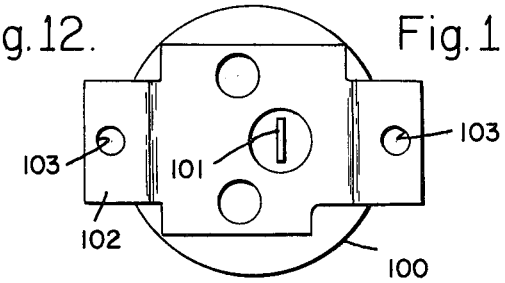
Fig. 11.
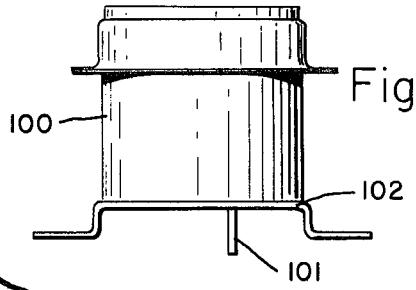
Fig. 10.
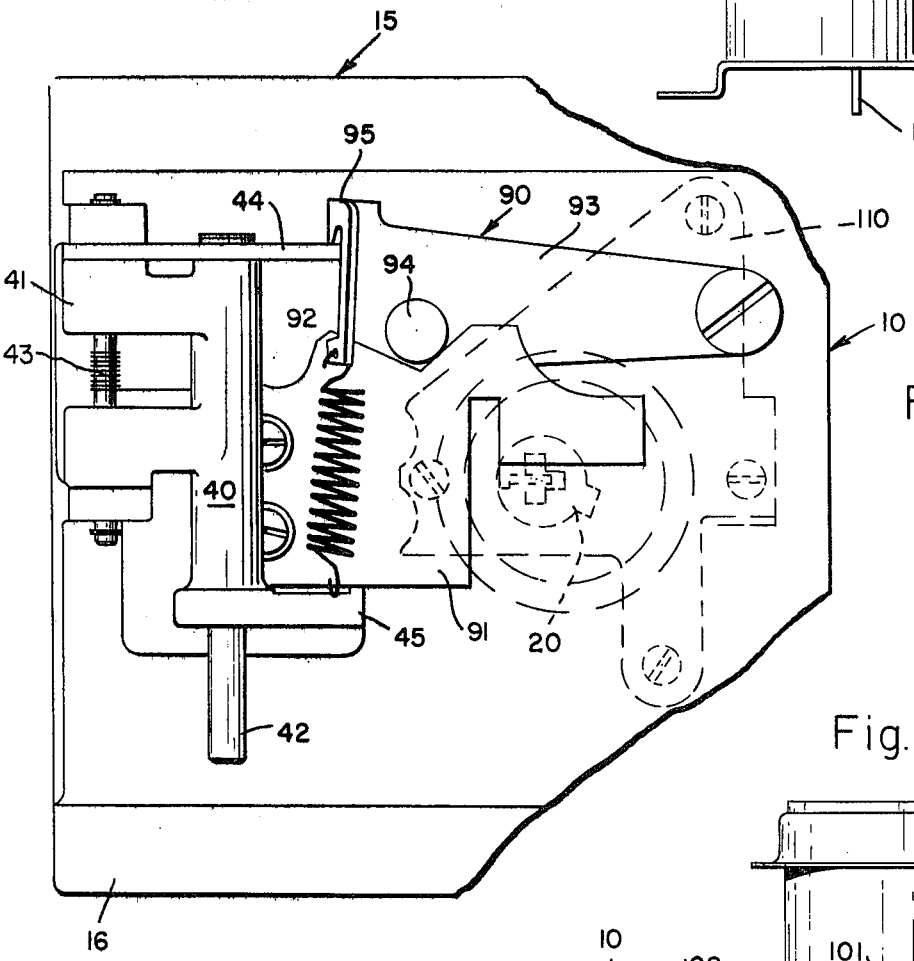
Fig. 15.
Fig. 14.
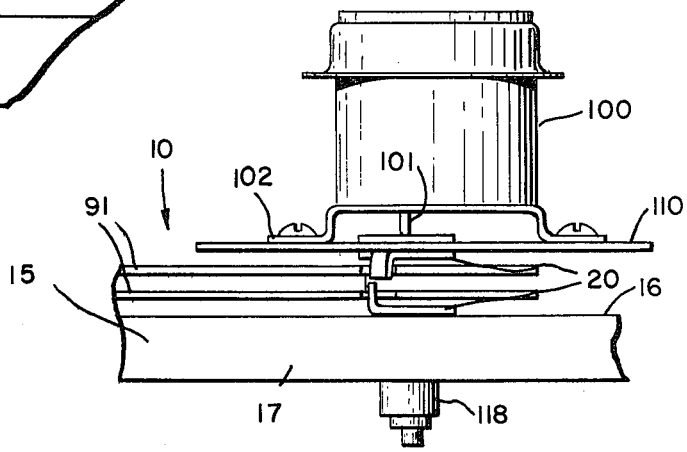

ELECTRIC SECURITY LOCK

BACKGROUND OF THE INVENTION

1. Field of the Invention

This invention relates to the field of door locks to which an alarm device is electrically coupled, and more particularly to an electric security lock particularly adapted to not only send an electrical signal to the alarm device, but also to be used as an emergency door opening device.

2. Description of the Prior Art

There are several emergency door opening devices, that also have provided an alarm device, now in use. U.S. Pat. No. 3,435,643, entitled Emergency Door Lock Having Alarm Means, issued to Edward C. Pollak and Bennett B. Harman on Apr. 1, 1969, describes one such emergency door opening device, including an alarm device. The alarm device is triggered by a micro electronic switch to which it is electrically coupled. The primary disadvantages of this emergency door opening device is that it is not very compact. Another disadvantage of this device is that it is not very sensitive to tampering by would be thieves because the alarm device is used not for security purposes, but for warning purposes. In order for a security lock to provide maximum security it must be very sensitive to tampering. According to the above patent this emergency door lock permits authorized personnel in possession of an appropriate key to open the door upon which the lock is installed, without sounding the alarm device, while allowing unauthorized personnel to open the same door in an emergency by sounding the alarm device which cannot be disconnected by subsequently closing the door unless the appropriate key is used.

Another emergency door opening device is described in U.S. Pat. No. 3,477,260, entitled Emergency Exit Lock, issued to Walter O. Balducci on Nov. 11, 1969. This emergency door opening device has a slender elogated case structure supporting a latch bolt for movement between projected and retracted positions. The latch bolt is moveable to a retracted position in response to the operation of an external manually operable lever. The lock also includes a latch bolt retractor and hold back mechanism operable independently of the lever in response to operation by a locking cylinder, which is operated by a key. The latter mechanism includes a cam and retractor elements which have coengaging surfaces. The cam element is arranged to move the retractor element in response to the rotation of the locking cylinder in order to move the latch bolt. There is also a hold back mechanism coupled to the retractor elements. This emergency door opening device does not provide an alarm device.

Another emergency door opening device which must be used with an associated alarm device is the subject of U.S. Pat. No. 2,958,215, entitled Safety Lock, issued to Nicholas C. Heyman on Nov. 1, 1960. This emergency door opening device is mechanically similar to the present invention but it does not have an electric activating apparatus for activating an alarm device.

None of the above described emergency door devices provide an electric activating apparatus for activating an alarm device in a remote location. All of these devices are large and cumbersome when mounted on a door; for some uses a more compact emergency door opening device would be far more beneficial than any of the prior art emergency door opening devices.

SUMMARY OF THE INVENTION

In view of the foregoing factors and conditions characteristic of the prior art it is a primary object of the present invention to provide an electric security lock that is not only a compact, surface mounted lock, but that also provides the security of a dead bolt lock.

It is another object of the present invention to provide an electric security lock that gives at a remote location an indication that someone has entered an area secured by the electric security lock.

It is still another object of the present invention to provide an electric security lock that is very sensitive to any tampering with either the exposed surfaces of the mounted lock or its dead bolt.

It is yet another object of the present invention to provide an electric security lock having a push bar emergency release as described in U.S. Pat. No. 3,477,260, which will also send an alarm signal to an alarm device.

In accordance with an embodiment of the present invention an electric security lock which not only provides an alarm signal to an alarm device, but also has a push bar emergency release is described. The electric security lock includes a dead bolt, a frame adapted to slideably receive the dead bolt on its bottom surface, a cover plate coupled to the bottom surface of the frame for holding the dead bolt therein, a pair of cams coupled to the dead bolt and adapted to move the dead bolt in a lateral direction, a locking cylinder coupled to each of the cams, and an electric activating apparatus coupled to the dead bolt. The electric activating apparatus includes a circular latch member pivotally mounted and spring-coupled to the dead bolt, a metal bar having a first end and a second end and also having a square hole disposed between the first and second ends, the first end is adapted to be coupled and uncoupled mechanically to the circular latch member, and a micro electronic switch which is mechanically coupled to the metal bar.

The electric security lock also includes an emergency release mechanism which activates the circular latch member and which has a device for retracting the dead bolt from its projected position and a device for deactivating the electric activating apparatus, mechanically coupled to the retracting device for use when a key is used to retract the dead bolt.

The features of the present invention which are believed to be novel are set forth with particularity in the appended claims.

Other objects and many of the attendant advantages will be more readily appreciated as the same becomes better understood by reference to the following detailed description and considered in connection with the accompanying drawing in which like reference symbols designate like parts throughout the figure.

DESCRIPTION OF THE DRAWINGS

FIG. 10 is a side elevational view of a locking cylinder used in conjunction with the electric security lock of FIG. 1.

FIG. 11 is bottom plan view of the locking cylinder of FIG. 10.

FIG. 12 is a side elevational view of a cam mounting plate used to mechanically couple the locking cylinder of FIG. 10 to the electric security lock of FIG. 1.

FIG. 13 is a top plan view of the cam mounting plate of FIG. 12.

FIG. 14 is a partial side elevational view which shows the locking cylinder and the cam mounting plate mechanically coupled to the electric security lock of FIG. 1.

FIG. 15 is a top plan view of the electric security lock of FIG. 1 on which the cam mounting plate is to be placed.

DESCRIPTION OF THE PREFERRED EMBODIMENT

The present invention is an electric security lock which provides not only alarm signals but also emergency exit capabilities. The electric security lock may be electrically coupled to any one of a variety of alarm devices including, but not limited to, television monitoring devices, silent alarm devices and conventional alarm devices. The present invention can best be described by reference to FIG. 1 wherein a top plan view of the preferred embodiment of an electric security lock 10 is shown.

Figure 1:
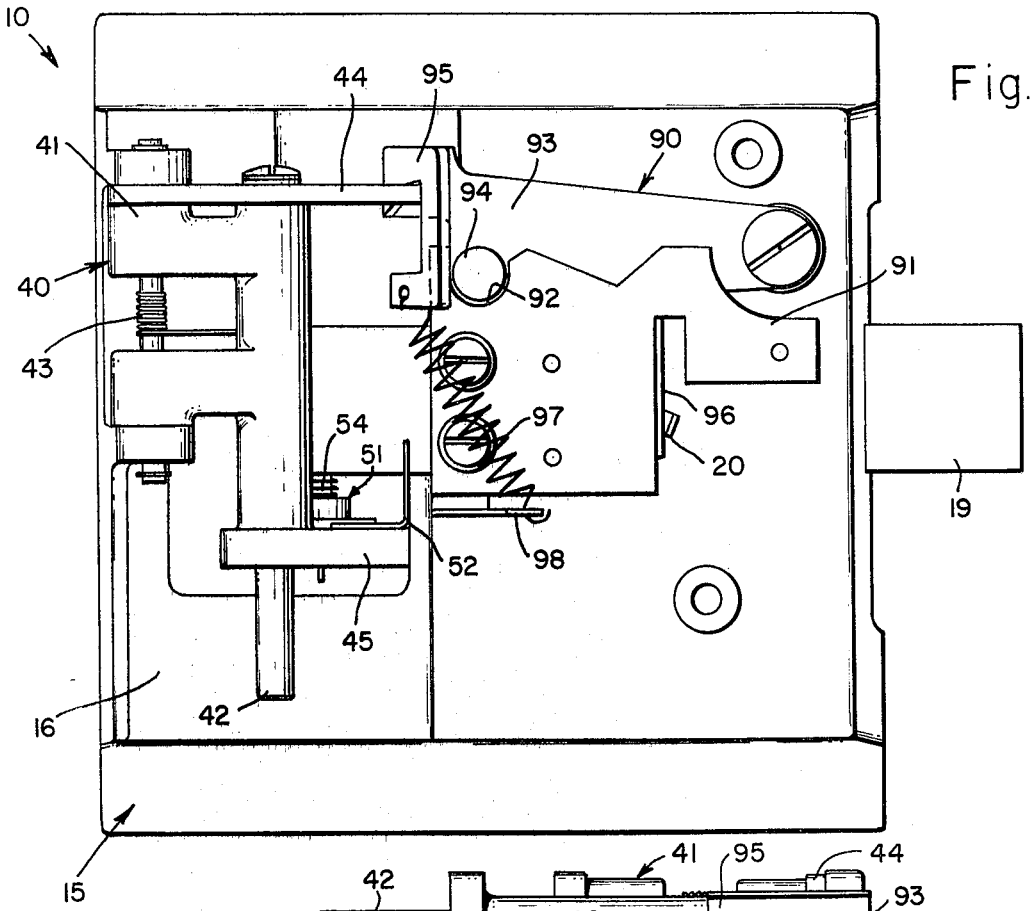
FIG. 1 is a top plan view of an electric security lock which has its locking cylinder removed in order to illustrate the internal mechanism of the electric security lock.
Figure 2:
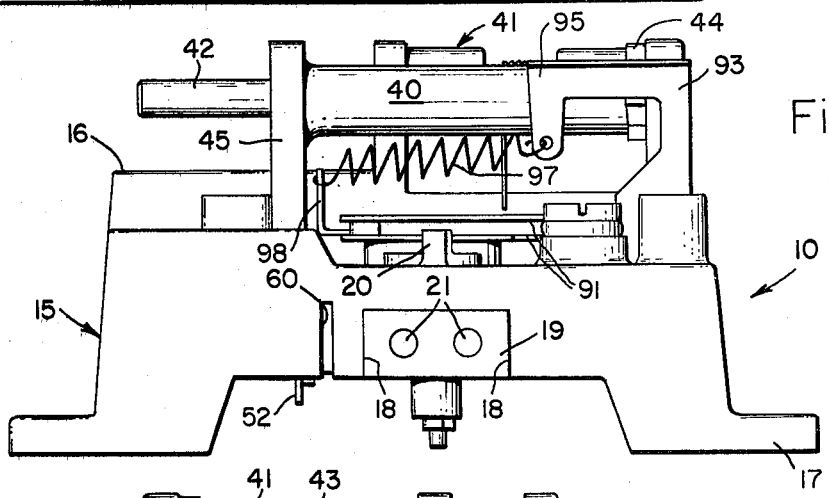
FIG. 2 is a front elevation view of the electric security lock of FIG. 1.

Referring now to FIG. 1 in conjunction with FIG. 2 the electric security lock 10 includes a frame 15 which has a top surface 16 and a bottom surface 17 having a rectangular groove 18 which is adapted to slideably receive a dead bolt 19. The electric security lock 10 also includes a pair of rotating cams 20 mechanically coupled to the dead bolt 19 and adapted to move the dead bolt 19 in a lateral direction within the rectangular groove 18.

Referring now to FIG. 2, which is a front elevation view of the electric security lock 10 showing that the dead bolt 19 is reinforced by a pair of steel inserts 21. Referring still to FIG. 2 but in conjunction with FIG. 1, the electric security lock 10 also includes an emergency opening apparatus 40. The frame 15 has a mounting member 41 joined to its top surface and disposed perpendicular thereto. The emergency opening apparatus 40 includes a panic bar member 42 which is pivotally connected and spring coupled to the mounting member 41 by a spring 43. The emergency opening apparatus 40 also includes a lever 44 pivotally connected to the mounting member 41 and fixedly coupled and disposed perpendicular to one end of the panic bar member 42. The panic bar member 42 also has an alarm activating member 45 fixedly coupled and disposed perpendicular to its other end.

Figure 3:
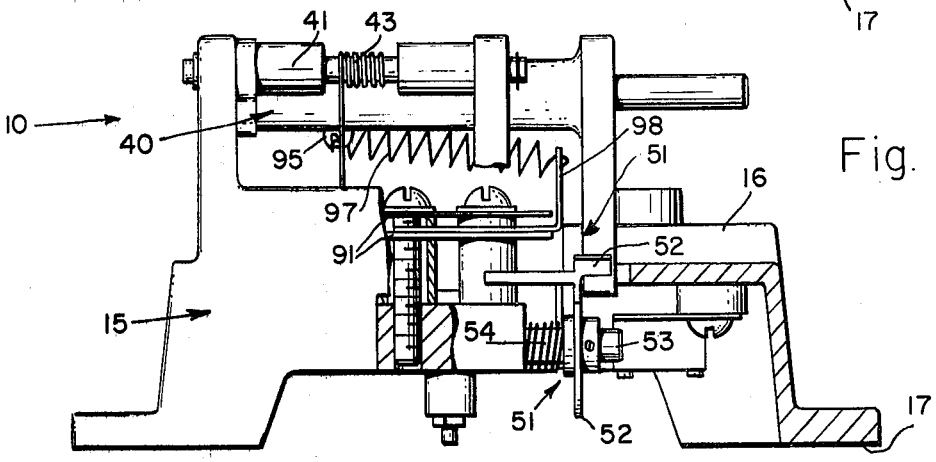
FIG. 3 is a back elevation view of the electric security lock of FIG. 1.
Figure 4:
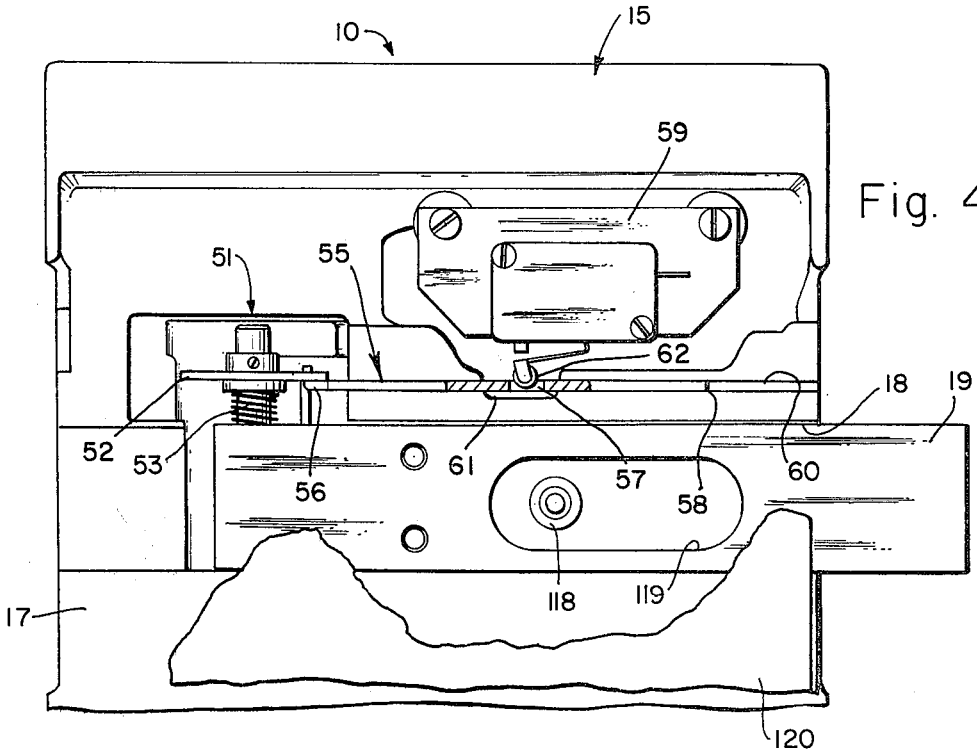
FIG. 4 is a bottom plan view of the electric security lock.

Referring now to FIG. 3 in conjunction with FIG. 4 the electric security lock 10 further includes an electric activating apparatus 51 which includes a circular latch member 52 coupled mechanically by a hardened steel pin 53 to the side of the dead bolt 19 near one of its ends. The circular latch member 52 is spring-coupled to the dead bolt 19 by a spring 54. The electric activating apparatus 51 also includes a bar 55 which has an L-shaped end 56, adapted to being coupled and uncoupled mechanically to the circular latch member 52. The bar 55 has a square hole 57 disposed midway between the L-shaped end 56 and a flat end 58. The electric activating apparatus 51 further includes a micro electronic switch 59 which is disposed on the bottom surface 17 of the frame 15.

Referring now to FIG. 4 which is a bottom plan view of the frame 15 showing the micro electronic switch 59 disposed on the bottom surface 17 of the frame 15. The frame 15 also has a think groove 60 which runs parallel to its rectangular groove 18 and adjacent thereto. The frame 15 also has a square window 61 disposed adjacent to the thin groove 60 and perpendicular to the bottom surface 17. The square window 61 is more readily seen by noting it in the cut away portion of FIG. 4. The square window 61 is aligned with a switch 62 of the micro electronic switch 59. The thin groove 60 is adapted to slideably receive the bar 55 so that the square hole 57 of the bar 55 aligns with its square window 61 when the dead bolt 19 is in a projected position or, when the electric security lock has been opened with a key, in a retracted position. When the circular latch member 52 engages the bar 55 and pulls it backwards it trips the switch 62 of the micro electronic switch 59 thereby sending an alarm signal to an alarm device.

Referring back to FIG. 1 the alarm activating member 45 of the panic bar member 42 is mechanically coupled to the circular latch 52 of the electric activating apparatus 51.

Figure 5:
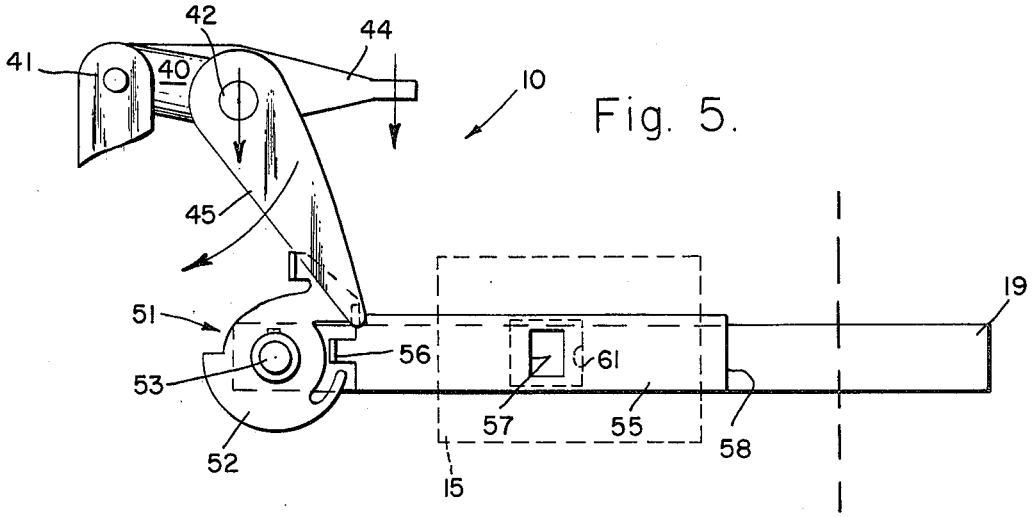
FIG. 5 is a schematic view of the emergency release device of the electric security lock of FIG. 1 when the electric security lock is in the closed position.
Figure 6:
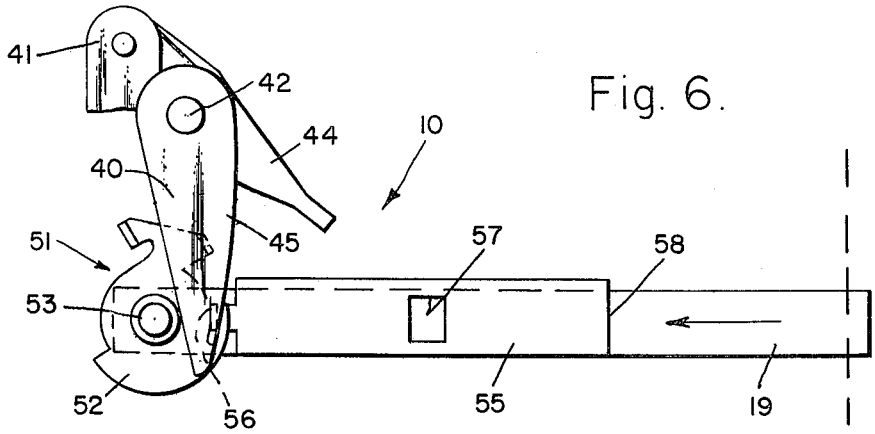
FIG. 6 is a schematic view of the emergency release device of the electric security lock of FIG. 1 when the electric security lock is in the opened position.

Referring now to FIG. 5 and FIG. 6 the operation of the emergency opening apparatus is shown. The electric security lock 10 has a handle mechanically coupled to the panic bar member 42 which, when pushed in an emergency, causes the panic bar member 42 to pivot about the mounting member 41. The pivoting panic bar member 42 forces the lever 44 downward towards the top surface 16 of the frame 15 thereby unlocking the locking apparatus 90. Once the locking apparatus 90 has been unlocked, the dead bolt 19 may be pulled back into the frame 15. The panic bar member 41 also forces the alarm activating member 45 downward toward the bottom surface 22 of the frame 15 and against the steel pin 53 to which the circular latch 52 is rotatingly coupled and which is fixedly mounted on and disposed perpendicular to a side of the dead bolt 19 so that not only is the dead bolt 19 pulled back into the frame 15 from its projected position, but also the circular latch 52 mechanically engages the bar 55 which is mechanically coupled to the switch 62 of the micro electronic switch 59, thereby triggering the alarm device.

Figure 7:
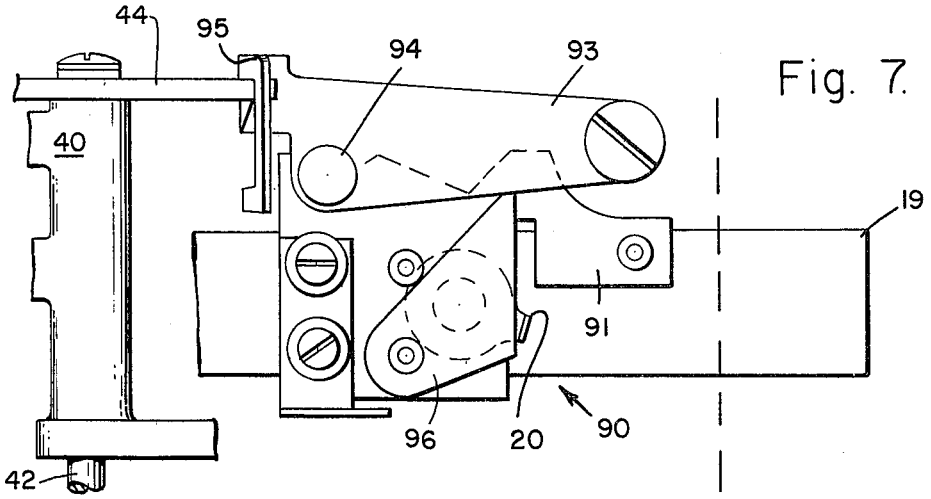
FIG. 7 is a schematic drawing of the unlocking mechanism of the electric security lock when the electric security lock is in the locked position.
Figure 8:
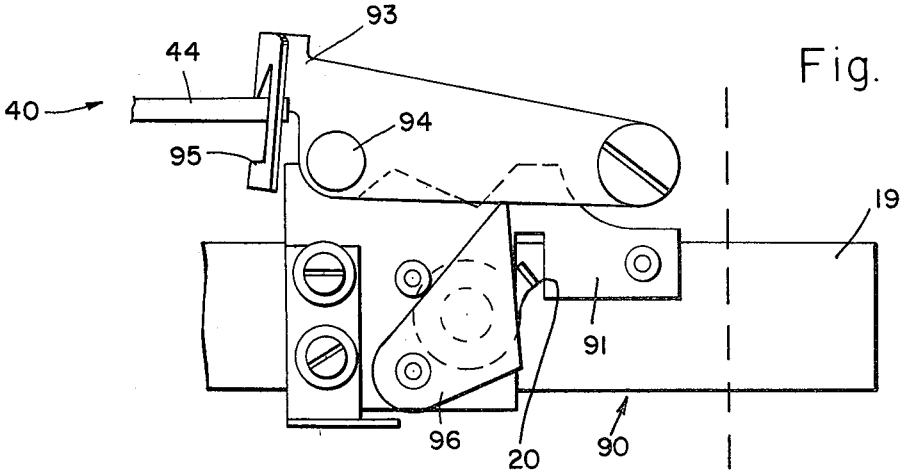
FIG. 8 is a schematic drawing of the unlocking mechanism of the electric security lock when the electric security lock is in the intermediate opened position.
Figure 9:
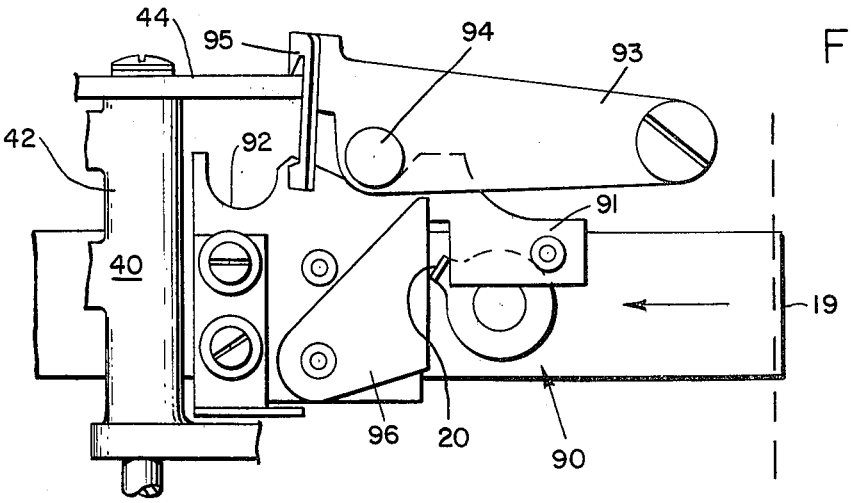
FIG. 9 is a schematic drawing of the unlocking mechanism of the electric security lock when the electric security lock is in the opened position.

Referring to FIG. 7 in conjunction with reference to FIG. 1 and FIG. 2, it can be noted that the electric security lock 10 also includes a locking apparatus 90 having a pair of cam plates 91 each of which is fixedly connected to the dead bolt 19 and which is disposed on the top surface 16 of the frame 15. Each of the cam plates 91 is mechanically coupled to one of the pair of the rotating cams 20 which move the cam plates 91 in a lateral direction thereby either retracting or projecting the dead bolt 19. Each cam plate 91 has a locking aperture 92 disposed substantially adjacent to the mounting member 41 of the frame 15. The locking apparatus 90 also has a locking lever 93, which is pivotally coupled to the top surface 16 of the frame 15 at one end and which has a disc 94, adapted to fit into the locking aperture 92. The locking lever 93 has a deactivating member 95 which is disposed perpendicular and fixedly joined to its end substantially adjacent to the disc 94 and mechanically coupled to the lever 44 of the emergency opening apparatus 40. Referring now to FIG. 8 and FIG. 9 in conjunction with FIG. 7, when the lever 44 moves downward towards the top surface 16 of the frame 15 it uncouples itself from the deactivating member 95 of the locking apparatus 90. The locking apparatus 90 also includes an unlocking plunger 96 which is pivotally mounted on the disposed between the cam plates 91. The unlocking plunger 96 is mechanically coupled to the pair of rotating cams 20 which, when they are rotated to open the electric security lock 10, force the unlocking plunger 96 to press against the locking lever 93 thereby uncoupling its disc 94 from the locking aperture 92 of the cam plates 91 allowing the cam plates 91 to move freely in a lateral direction. The locking apparatus further includes a spring 97, which is mechanically coupled to a spring mounting member 98 and to the deactivating member 95 so that the deactivating member 95 may be sprung back into place after it has deactivated the locking apparatus 90.

Referring now to FIG. 10 in conjunction with FIG. 11, a locking cylinder 100 which has a mechanical coupling member 101 and a mounting member 102 with a pair of mounting holes 103 disposed adjacent to the mechanical coupling member 101, which may also be designated as the shaft of the locking cylinder 100.

Referring now to FIG. 12 in conjunction with FIG. 13 a cam mounting plate 110 is mechanically to one of the cams 20.

In order to best understand the relationship between the locking cylinder 100 and the cams 20 it is necessary to refer to FIG. 14 in conjunction with FIG. 15. In FIG. 14 the relationship between the cams 20 and the mechanically coupling member 101 is readily seen. In FIG. 15 the placement of the cam mounting plate 110 is shown in phantom lines.

The lower cam 20 is coupled to a shaft 118 shown in FIG. 4 and in FIG. 14. The slot 119 in the dead bolt 19 is essential in order that the shaft 118 not obstruct the movement of the dead bolt 19. Each of the pair of rotating cams 20 is mechanically coupled to one of the pair of cam plates 91 as shown in FIG. 14. Referring back again to FIG. 4 the shaft 118 is mechanically coupled to a cover plate 120 which is adapted to secure the dead bolt 19 in place and which is mechanically coupled to bottom surface 12 of the frame 15.

Until the invention of the electric security lock there have been no compact emergency opening devices which also have alarm coupling devices. Furthermore, these alarm coupling devices may be coupled to electrical alarm devices at a remote location. The advantage of this electric security lock is that not only is it compact, but that it is also an alarm coupling device.

From the foregoing it can be seen that an improved electric security lock has been described. Accordingly, it should be noted that the figures are not drawn to scale, and distances of and between the figures are not to be considered significant.

Accordingly, it is intended that the foregoing disclosure and showing made in the drawing shall be considered only as illustrations of the principles of the invention. The invention is set forth in the appended claims.

What is claimed is:

1. In an electric security lock including:

a. a dead bolt;

b. a frame, having a top side and a bottom side, with said bottom side adapted to slideably receive said dead bolt;

c. a cover plate coupled to said bottom side of said frame and adapted to secure said dead bolt in place;

d. a pair of rotating cams coupled to said dead bolt and adapted to move said dead bolt in a lateral direction; and e. a locking cylinder, which includes a mounting member coupled to said top of said frame and a mechanical coupling member coupled to said cam, an electric activating apparatus comprising:

a. a circular latch member pivotably connected and spring coupled to said dead bolt;

b. a metal bar having a first end and a second end and also having a square hole disposed between said first and second ends adapted to be mechanically coupled and uncoupled to said circular latch member, said metal bar being disposed in a slot in said bottom of said frame, said slot being disposed parallel and adjacent to said dead bolt in said frame, said frame also having a square window disposed along said slot; and c. a micro electronic switch disposed on said bottom of said frame adjacent to said slot and coupled to said metal bar through said square window of said frame.

2. In an electric security lock according to claim 1, wherein said security electric security lock also includes an emergency opening apparatus comprising: (a) a means for retracting said dead bolt from its projected position pivotally mounted to said frame, and mechanically coupled to said circular latch member of said electric activating apparatus so that when said dead bolt is retracted it activates said micro electronic switch; and (b) means for deactivating said micro electronic switch when a key is used to retract said dead bolt from its projected position.

3. An electric security lock according to claim 2 wherein said means for mechanically coupling said circular latch member comprises:

a. a mounting member disposed on said top of said frame;

b. a panic bar member pivotally connected to said mounting member and spring coupled to said mounting member; and c. an alarm activating member which is disposed perpendicular to and mechanically coupled to said panic bar member, said alarm activating member being mechanically coupled to said circular latch member of said electric activating apparatus.

4. An electric security lock according to claim 3 wherein said means for deactivating said alarm means comprises:

a. a deactivating member pivotally mounted to said mounting member and rigidly mounted to said panic bar member;

b. a locking lever pivotally joined to said top side of said frame and adapted to be mechanically coupled and uncoupled to said deactivating member, said locking lever having a disc disposed at its end opposite the end pivotally coupled to said frame;

c. a cam plate having a locking aperture which holds said disc when said dead bolt is in its retracted position; and d. means for pivotally rotating said locking lever so that said disc may be lifted out from said locking aperture on said cam plate.

* * * * *